US007111341B2

(12) United States Patent
Hennings et al.

(10) Patent No.: US 7,111,341 B2
(45) Date of Patent: Sep. 26, 2006

(54) UNIVERSALLY ADJUSTABLE BEDSTEAD SYSTEM

(76) Inventors: Eric D Hennings, 1980 Garner Ave., Moville, IA (US) 51039; Donald R Hennings, 1970 Garner Ave., Moville, IA (US) 51039

( * ) Notice: Subject to any disclaimer, the term of this patent is extended or adjusted under 35 U.S.C. 154(b) by 0 days.

(21) Appl. No.: 10/867,106

(22) Filed: Jun. 12, 2004

(65) Prior Publication Data

US 2005/0273929 A1 Dec. 15, 2005

(51) Int. Cl.
*A47C 19/20* (2006.01)

(52) U.S. Cl. ..... 5/201; 5/2.1; 5/9.1

(58) Field of Classification Search ..... 5/200.1, 5/200, 400, 2.1, 8, 9.1, 201
See application file for complete search history.

(56) References Cited

U.S. PATENT DOCUMENTS 895,898 A * 8/1908 Scheer ..... 5/9.1
2,647,267 A * 8/1953 McLaughlin ..... 5/9.1
3,336,605 A * 8/1967 Neunherz et al. ..... 5/9.1
3,952,342 A * 4/1976 Hart ..... 5/2.1
4,196,484 A * 4/1980 Harris ..... 5/201
4,312,086 A * 1/1982 Bianco ..... 5/2.1
5,012,538 A * 5/1991 Timm ..... 5/201
5,173,974 A * 12/1992 Proano et al. ..... 5/2.1
5,233,707 A * 8/1993 Perkins ..... 5/8
5,655,234 A * 8/1997 Randleas ..... 5/9.1
5,983,420 A * 11/1999 Tilley ..... 5/2.1
6,018,829 A * 2/2000 Rosenquist ..... 5/9.1
6,167,579 B1 * 1/2001 Kopish ..... 5/2.1
6,292,959 B1 * 9/2001 Rosenquist ..... 5/9.1
6,314,595 B1 * 11/2001 Price ..... 5/201
6,560,792 B1 * 5/2003 Rosenquist ..... 5/9.1
6,581,221 B1 * 6/2003 Rosenquist ..... 5/9.1
6,925,665 B1 * 8/2005 Hennings ..... 5/200.1
6,983,494 B1 * 1/2006 Jannetides ..... 5/9.1
2003/0041375 A1 * 3/2003 Rosenquist ..... 5/9.1
2003/0041376 A1 * 3/2003 Rosenquist ..... 5/9.1
2005/0273929 A1 * 12/2005 Hennings et al. ..... 5/201
2006/0085909 A1 * 4/2006 McBrayer et al. ..... 5/2.1
2006/0090262 A1 * 5/2006 Hennings et al. ..... 5/658
2006/0107457 A1 * 5/2006 Jannetides ..... 5/9.1

* cited by examiner

*Primary Examiner*—Robert G. Santos

(57) ABSTRACT

A collection of adjustable, easy to assemble and reconfigurable bedstead elements which when used in conjunction with one another may be used to construct a single or multiple bedstead arrangement that can conform to a wide variety of spatial delineations, functional necessities, mattress specifications and individual design preferences.

24 Claims, 13 Drawing Sheets

64
50
58
56
48
60
62
54
52
66

UNIVERSALLY ADJUSTABLE BEDSTEAD SYSTEM

FIELD OF THE INVENTION

The present invention relates in general to methods and apparatus for assembling an adjustable bedstead into a multiplicity of configurations.

BACKGROUND

The use of beds in family dwellings, apartments, dorm rooms or military barracks is ubiquitous yet bedsteads are usually very limited in their scope of configurability. Each sleeping area has its own unique characteristics for a bedstead to conform. The environment of the sleeping area may also have to oblige other furniture or living needs. Mattresses too come in a variety of sizes and models to which the bedstead must conform for proper use. Most important is the desire to configure a bedstead in an arrangement suitable to the individual needs and wants of the user that present day bedsteads fail to provide. It is consequently a difficult task to search for a bedstead that will meet all of the requirements dictated by sleep area characteristics, mattress design and user predilection.

As the users situation changes the inflexible nature of most bedsteads requires their replacement or irreversible modification. What is needed is a bedstead which can be comprised from sets of simple adjustable elements that allow even an unskilled user to configure a single or multiple bedstead to the requirements of its surroundings, mattress specifications and individual design preference. The chosen configuration should be able to perform the function of supporting the mattress/s and user/s in a safe and reliable fashion while also fulfilling the practical needs of the functional environment and the aesthetic desires of the user.

SUMMARY

This invention teaches a bedstead comprised of simple adjustable elements which allow a user to construct a single or multiple, safe and reliable bedstead according to the requirements of spatial delineations, functional necessities, mattress specifications and individual design preference. Aspects of the adjustable nature of the bedstead may include a main frame, possibly including a plurality of mattress receiving surfaces. The main frame may include frame legs that can accept a variety of supporting legs and/or end members. The mainframe might also accept a variety of posts to support a second mainframe and/or ascending hardware. The mainframe may also include means for coupling two or more mainframe together in a tandem, parallel or perpendicular relation on a relatively similar or dissimilar horizontal plane. The main frame may also include means to attach accessories such as ladders, safety rails, or shelves.

The bedstead may also include a variety of methods to assure the integrity of the bedstead while in use which may comprise block, screw, spring or tension based locking apparatus.

DETAILED DESCRIPTION OF THE PREFERRED EMBODIMENTS

In the following detailed description, reference is made to the accompanying drawings which form a part hereof, and in which is shown by way of illustration specific embodiments in which the invention may be practiced. These embodiments are described in detail sufficient to enable those skilled in the art to practice the invention, and it is to be understood that other embodiments may be utilized and that structural, logical and mechanical changes may be made without departing from the spirit and scope of the present invention. The following detailed description is, therefore, not to be taken in a limiting sense, and the scope of the present invention is defined by the appended claims.

Figure 1:
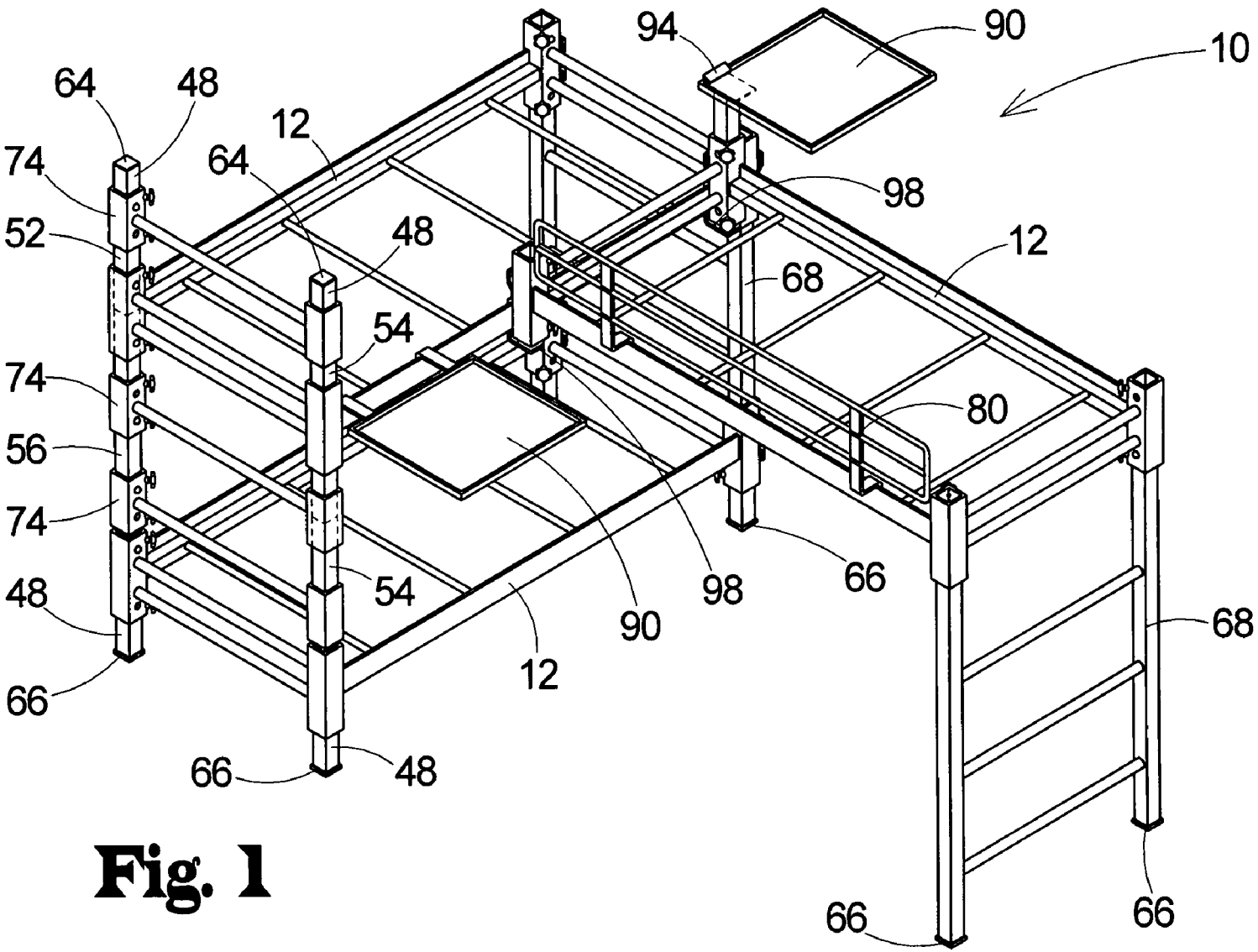
FIG. 1 is a perspective view of a bedstead configuration using a number of adjustable elements of the invention.

FIG. 1 demonstrates one of the many configurations the illustrated embodiment utilizes; three mainframes (12), two end assemblies (68), four posts (48) of three different lengths (52, 54 and 56) and three cross posts (74). Other optional elements employed in the design but not essential to the structural integrity include; a safety rail (80), a shelf (90), a cap (64) a foot (66) and a locking mandible (98).

Using various elements illustrated in FIG. 1 it would be possible to construct a diverse assortment of bedstead configurations to meet the unique characteristics of a wide variety of sleeping areas and a preponderance of desires from the common user. The universal adjustability of the bedstead is conferred to the system through the attributes of its individual elements which are detailed in the following descriptions.

Figure 2:
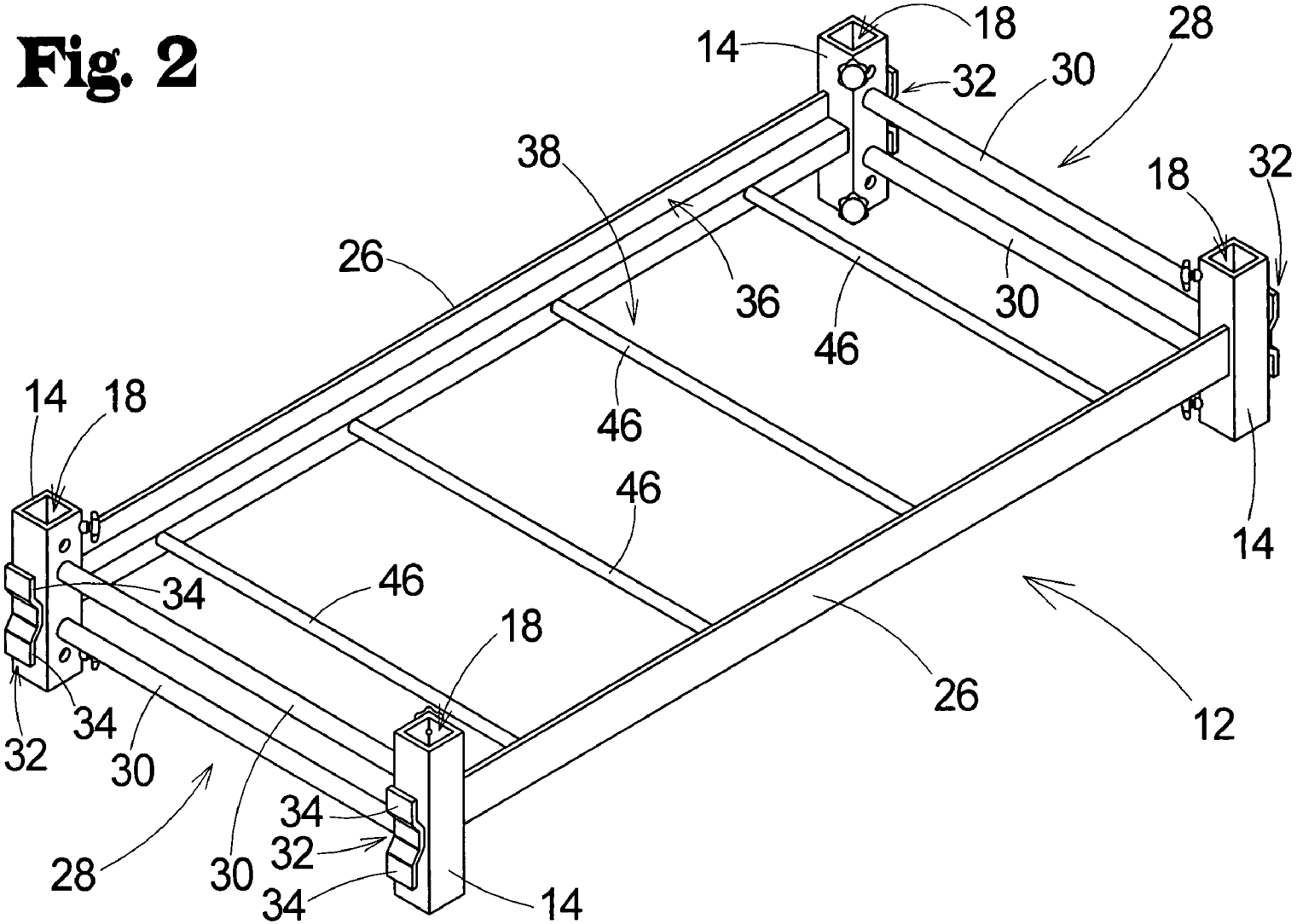
FIG. 2 is a perspective view of a mainframe embodiment of the present invention.

FIG. 2 depicts an embodiment of a mainframe (12). The function of the mainframe (12) is to support the mattress and thereupon, one or more users (2) and may be the basic element of the universally adjustable bedstead (10). The mainframe (12) may consist of a number of frame legs (14), a number of side members (26) and a number of end members (28).

The embodiment illustrated in FIG. 2 depicts four frame legs (14) located at the corners of the mainframe (12) with a pair of side members (26) connecting pairs of the frame legs (14) along the long sides of the mainframe (12) and end members (28) connecting pairs of frame legs (14) along the short sides of the mainframe (12). A grid (38) may connect the side members (26) to form a support area for the mattress (2).

In the embodiment of FIG. 2 the end members (28) consist of a pair of round cross pieces (30) connecting the frame legs (14) located generally above and below the level of the side members (26). End members (28) could alternately consist of any number of connecting pieces of any shape including traditional headboard and or foot board designs.

Similarly the grid (38) illustrated in the FIG. 2 embodiment consists of four struts (46) which would be sufficient to support a mattress (2) and one or more users, by distributing the weight to the side members (26) and then on to the frame legs (14). Such struts may be connected to either side member/s (26), end member/s (28) or a combination thereof. Alternate embodiments to the grid (38) might include a solid plate of metal, wood, plastic or other material, a lattice of rigid material such as a steel mesh panel (44), a web or net of filament or tensile material which may consist of but is not limited to metal wire, nylon or textile cord, wicker, and/or leather.

Figure 3:
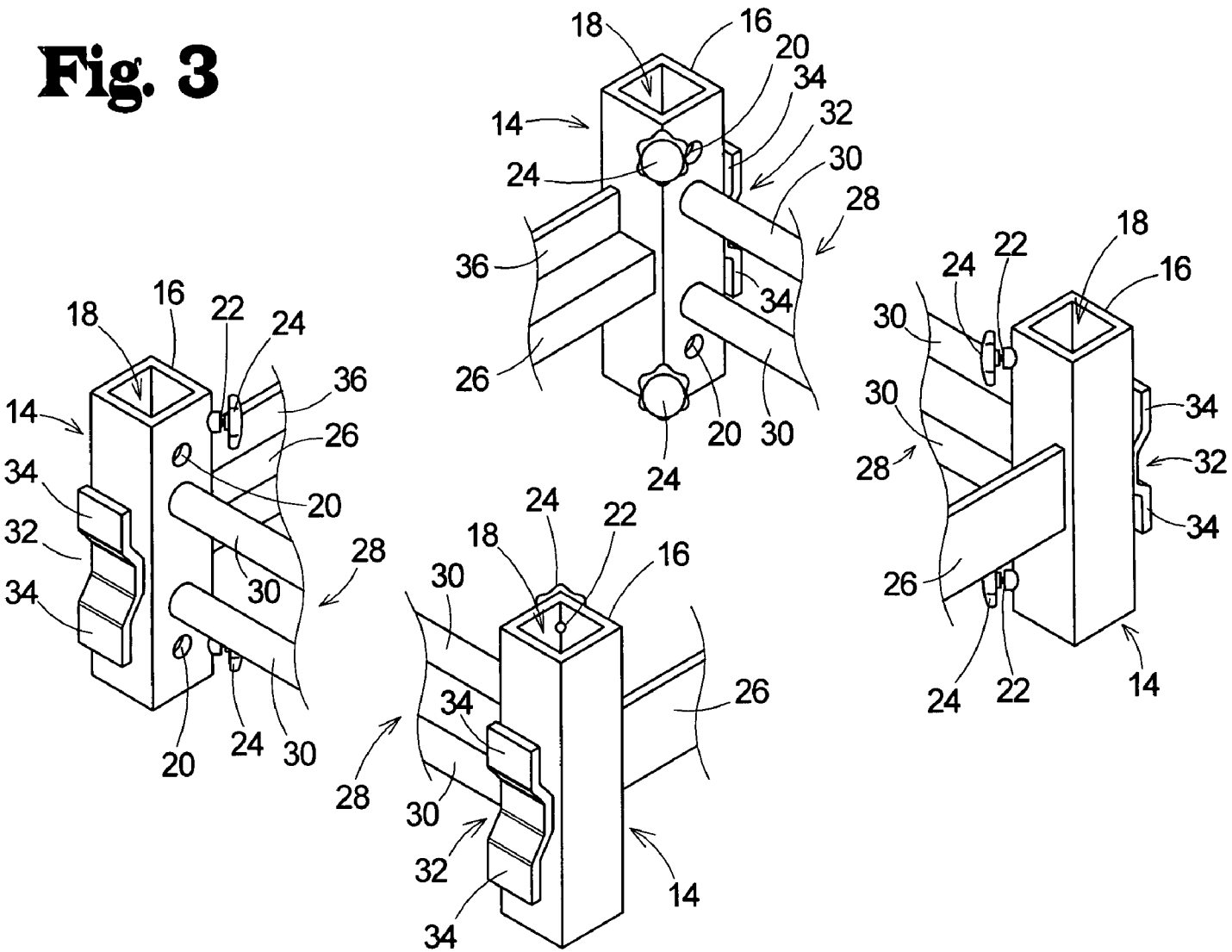
FIG. 3 is a detail of an embodiment of main frame, frame legs and their functional elements.

FIG. 3 illustrates the details of a particular embodiment of the frame legs (14). The frame legs (14) are depicted as polygonal hollow columns with post throughput (18) passing through the {frame leg (14)} from end to end for possibly receiving one or more posts (48). The exterior of the frame leg (14) is referred to as the leg perimeter (16).

The frame leg (14) configuration illustrated in FIG. 3 is depicted as a square sleeve but in alternate embodiments may comprise a generally circular, rectangular, oval, pentagonal, hexagonal, heptagonal, octagonal, etcetera, configuration of a length sufficient to accept the attachment of a side member (26) and end member (28).

The leg perimeter (16) is the site where the side member (26) or end member (28) may connect to the frame leg (14). There may be a number of first engaging apertures (20) in the frame leg (14) going from the leg perimeter (16) to the post throughput (18). Likewise a number of lock apertures (22) may be included in the frame leg (14) going from the leg perimeter (16) to the post throughput (18).

The locking device (24) depicted in the FIG. 3 embodiment is a screw with a hand knob for easy tightening. The screw may engage an aperture (60) in the post (48) or may just tighten against the exterior of the post (48). Alternate locking devices (24) may include but are not limited to; a bolt with locking cotter pin, a threaded bolt or tool headed screw, a self biasing plate or wedge, a locking plug or other similar locking methods familiar to those of skill in the art. The locking device (24) may be used in conjunction with other engaging devices such as a spring biased de(te)nt (62) or exclusively. The first engaging apertures (20) and locking apertures (24) may be mounted on the leg perimeter (16) in nearly any location that may correspond to their respective engaging elements of the post (48).

Coupling member (32) may be attached to the leg perimeter (16) of the frame leg (14) to allow the mainframe (12) to be attached to a second mainframe (12). The specific method illustrated in FIG. 3 consists of double hook (34) one hook (34) oriented for embracing the top of a mainframe's (12) side member (26) such that it could be secured by gravity and a second hook (34) oriented for embracing the bottom of a mainframe's (12) side member (26) such that it would require additional securing means such as a mandible (98). One or more coupling members (32) would be mounted on the frame leg (14) on one or more of leg perimeter's (16) outwardly facing surfaces.

Figure 4:
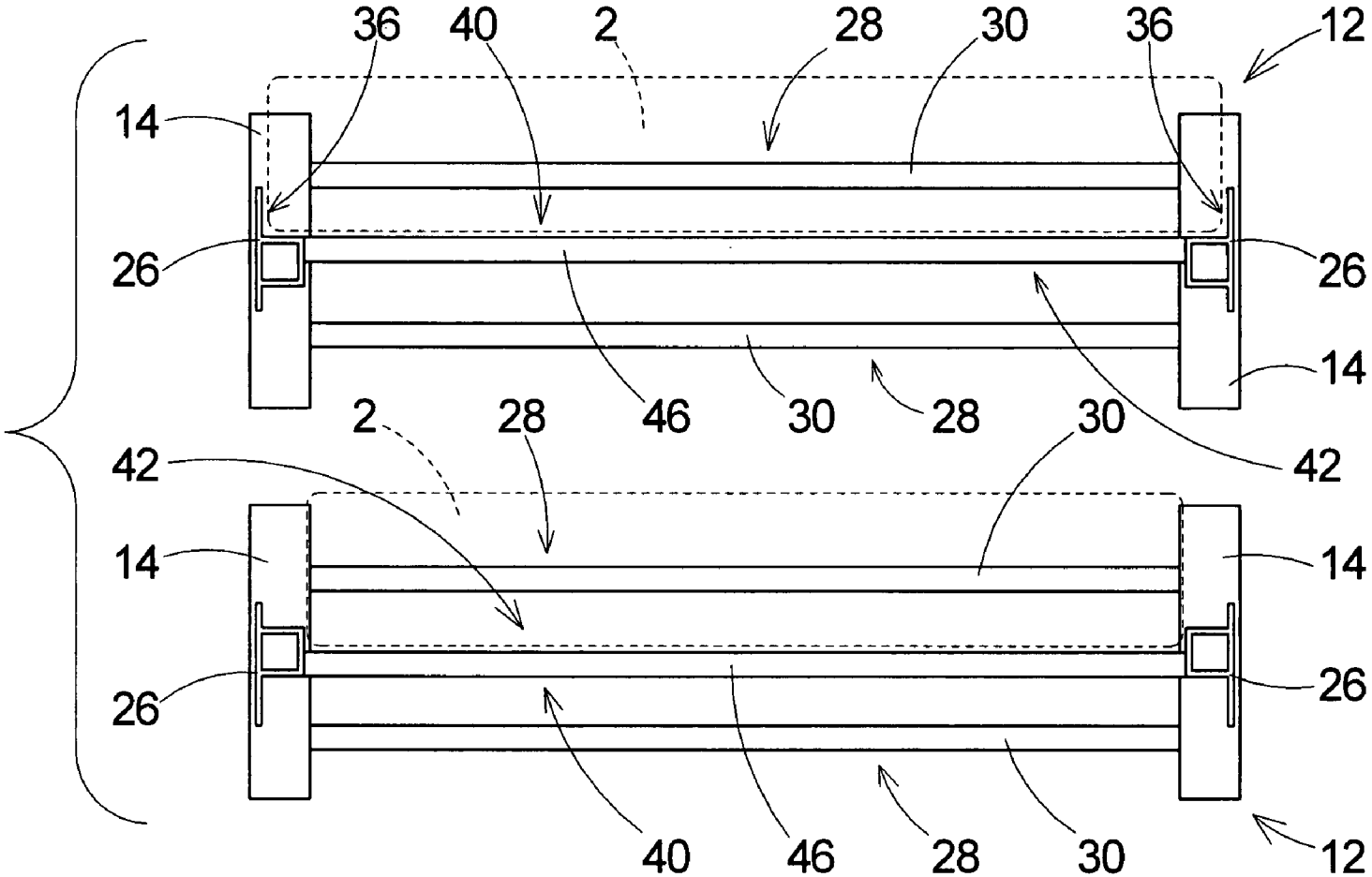
FIG. 4 is a pair of cross sectional views of a main frame embodiment showing how each side can accommodate different sized mattresses.

FIG. 4 illustrates the ability for the main frame (12) to accept two different sized mattresses (2). The mattress (2) receiving characteristics of each side of the grid (38) may conform to specific standards of mattresses (2). The example illustrated on the top embraces the mattress (2) by use of the interior barrier (36) of the side member (26). In the top example the mattress would be supported by the grid first side (40) and would be kept in place by the interior barrier (36). In the lower example the mattress (2) is supported by the grid second side (42) and is contained between the inmost sides of the side members (26) from which the grid (38) or as demonstrated in the figure the struts (46) are attached. The decision to use either side can be based solely on the size of the mattress (2) without impacting the structural considerations because all configurable aspects of the main frame (12) are symmetric in their design.

Figure 5:
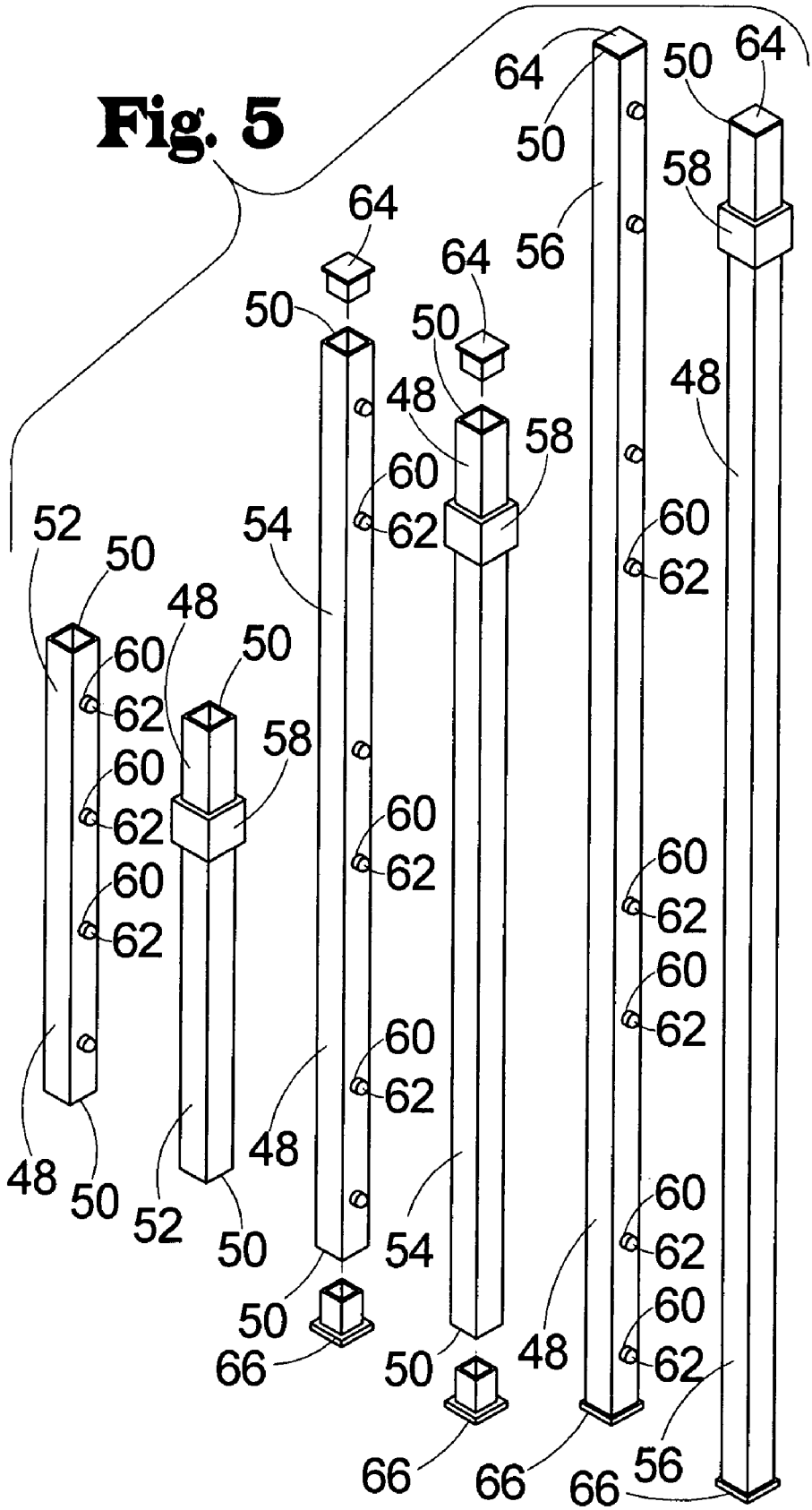
FIG. 5 is a perspective view of various sizes and styles of posts and their constituent parts in accordance with embodiments of the present invention.

FIG. 5 depicts six posts (48) that are illustrated in this embodiment as square tubes. The square cross-sectional shape of the posts (48) conforms to the shape of the shape of the post throughput (18). As exemplified above the cross-sectional shape of the post (48) may vary in the same manner that the frame leg (14). The shapes of respective posts (48) and post throughputs (18) do not necessarily need to match as dissimilar shapes may function adequately. For example a round post (48) may work just as effectively in a square post throughput (18), correspondingly an octagonal or even X shaped post (48) may work using a square post throughput (18).

Of the six posts (48) represented in FIG. 5, three employ a block (58) style support method while the remaining three include a spring biase {d} detent (62) for support of the main frame (12). Pairs of each style of posts (48) are shown in their various sizes; short posts (52), intermediate posts (54) and long posts (56). The length of any of the posts (48) may vary and the separation of posts (48) into three categories (52, 54 & 56) is merely for demonstrative examples of bedstead configuration. The illustrated lengths of posts (48) are depicted in a ratio that denotes the second pair of posts (48) or intermediate posts (54) are twice as long as the first pair of posts (48) or short posts (52) and the third pair of posts (48) or long posts (56) are three times as long as the first pair of posts (48) or short posts (52). The ratio of one, two and three will allow a user to create combinations of post (48) lengths based on the common denominator of the length of the short post (52). This is demonstrated in FIG. 1 wherein a set of posts (48) on the left, comprising a short post (52) on the top and a long post (56) on the bottom, is compatible with the set of post (48) on the left which comprise a pair of intermediate posts (54).

Figure 6:
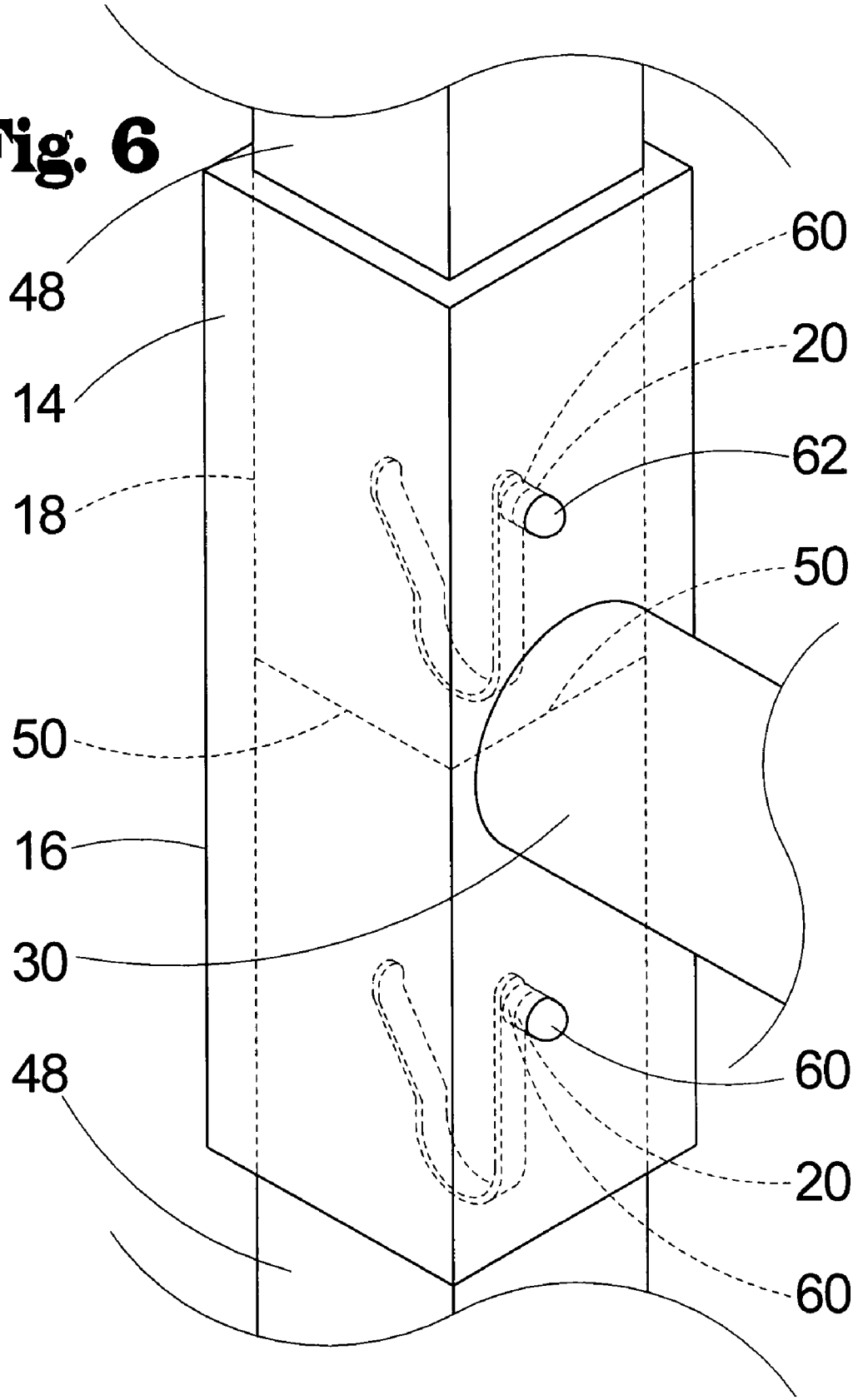
FIG. 6 is a perspective view of two posts engaged within a frame leg of the present invention.

The spring biased detent (62) style of post (48) uses spring biased detents (62) located along the length of the post (48) to engage the first engaging apertures (20) of a main frame (12) or cross post leg (76) to support such adjustable bedstead assemblies at the desired point. The embodiment of the spring biased detent (62) style posts (48) illustrated in FIGS. 5 and 6 include mated pairs of second engaging apertures (60) and their related spring biased detents (62) at regular intervals along the length of the post (48) corresponding to the length of the short post (52). The space between the related second engaging apertures (60) of each mated pair may be equal to the space between the first engaging apertures (20) of the main frame (12) or cross post (74) so that the spring biased detents (62) may engage two first engaging apertures (20) when both sets of apertures are aligned to one another. The space between one of second engaging apertures (60) and the post ends (50) may equal half the distance between mated pairs of first engaging apertures (20) of a main frame (12) or cross post (74) so that the main frame (12) or cross post (74) can act as a means for coupling two posts (48) to one another. If the combined distance between second engaging apertures (60) and the post ends (50) of two posts (48) equal (not necessarily an equal distance) the distance between the first engaging apertures (20) of a main frame (12) or cross post (74) the post ends (50) of each of the posts (48) may contact each other so that the weight of the upper post (48) and or anything it is supporting could be transmitted directly to the lower post (48) directly, not requiring the spring biased detents (62) to bear any of the weight. This concept is best illustrated in FIG. 6. Alternate embodiments may include a series second engaging apertures (60) much denser than illustrated along the entire length of the post (48) so that a main frame (12) or cross post (74) may be placed at any incremental spot along the length of the post (48).

The block (58) style of post (48) uses an obstructive mass attached to the post (48) that may inhibit the passage of the post (48) through the post throughput (18) beyond the point of the mass. Thus the block (58) may support the main frame (12) at the point of the block (58). The block (58) may be attached to the post (48) at a point down from the top post end (50) to facilitate proper support of a main frame (12) or cross post leg (76). The block (58) depicted in FIG. 5 is a collar that encircles the perimeter of the post (48). Alternately the block (58) may be adjustably attached to the post (48) using such means for connection as a locking device (24) or a first engaging aperture (20) with a spring biased detent (62) or other similar methods as noted above. At the bottom end of the post (48) it may be useful to employ a foot (66) to distribute the weight of the post (48) and any other parts of the bedstead it may support evenly to the floor. The foot (66) may also provide a non-slip surface that could prevent the post (48) from shifting from its place on the floor. The design of the foot (66) would be such as to provide a cushioning barrier layer between the end of the post (48) and the floor. The foot (66) may also be designed to be insertible into the end of the post (48) and stay fixed through a frictional or spring bias so that the foot (66) would not fall out or become lost while reconfiguring the bedstead. Likewise the top of the post (48) may include a cap (64) to provide the functions of, preventing foreign objects from being inserted into the top of the post (48), to cushion the top from impacts, contact or injury or for aesthetic purposes.

Figure 7:
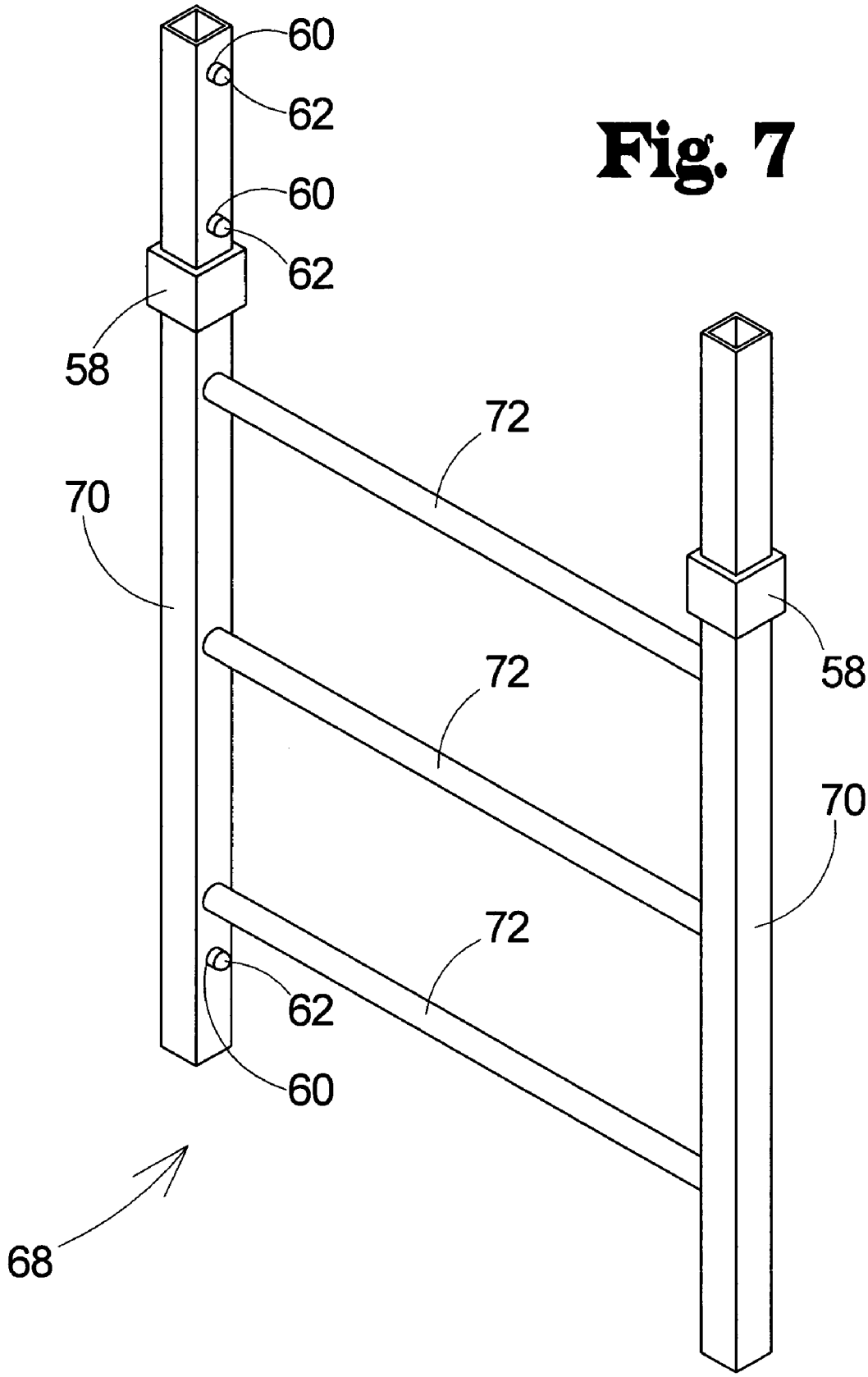
FIG. 7 is a perspective view of an embodiment of an end assembly connected and its constituent parts.

FIG. 7 shows one embodiment of an end assembly (68). The end assembly (68) may consist of one or more pillars (70) which may be connected to one another other possibly perpendicularly by a number of cross members (72). The pillars (70) much like the posts (48) are designed to fit through the post throughputs (18) of the frame legs (14) of a main frame (12). Similar to the posts (48) the pillars (70) of the end assembly (68) may include blocks (58), second engaging aperture (60) and spring biased detents, or in may rely on the upper most cross member (72) to support the frame leg (14) of the main frame (12) at the desired point. FIG. 7 depicts an embodiment employing both the block (58) and spring biased detents (62) for the purpose of illustration but it is anticipated that either individual method or a combination of both methods could be employed without straying from the scope of the invention. By spacing the cross members (72) at regular intervals along the pillars (70) the cross members (72) may be used like rungs on a ladder to ascend to a mattress (2) mounted in an elevated or "lofted" position. Like wise the pillars (70) may be used as a rail handle in the same manner as a ladder especially if the pillars (70) extend above the horizontal level of the main frame (12) and or mattress (2).

Figure 8:
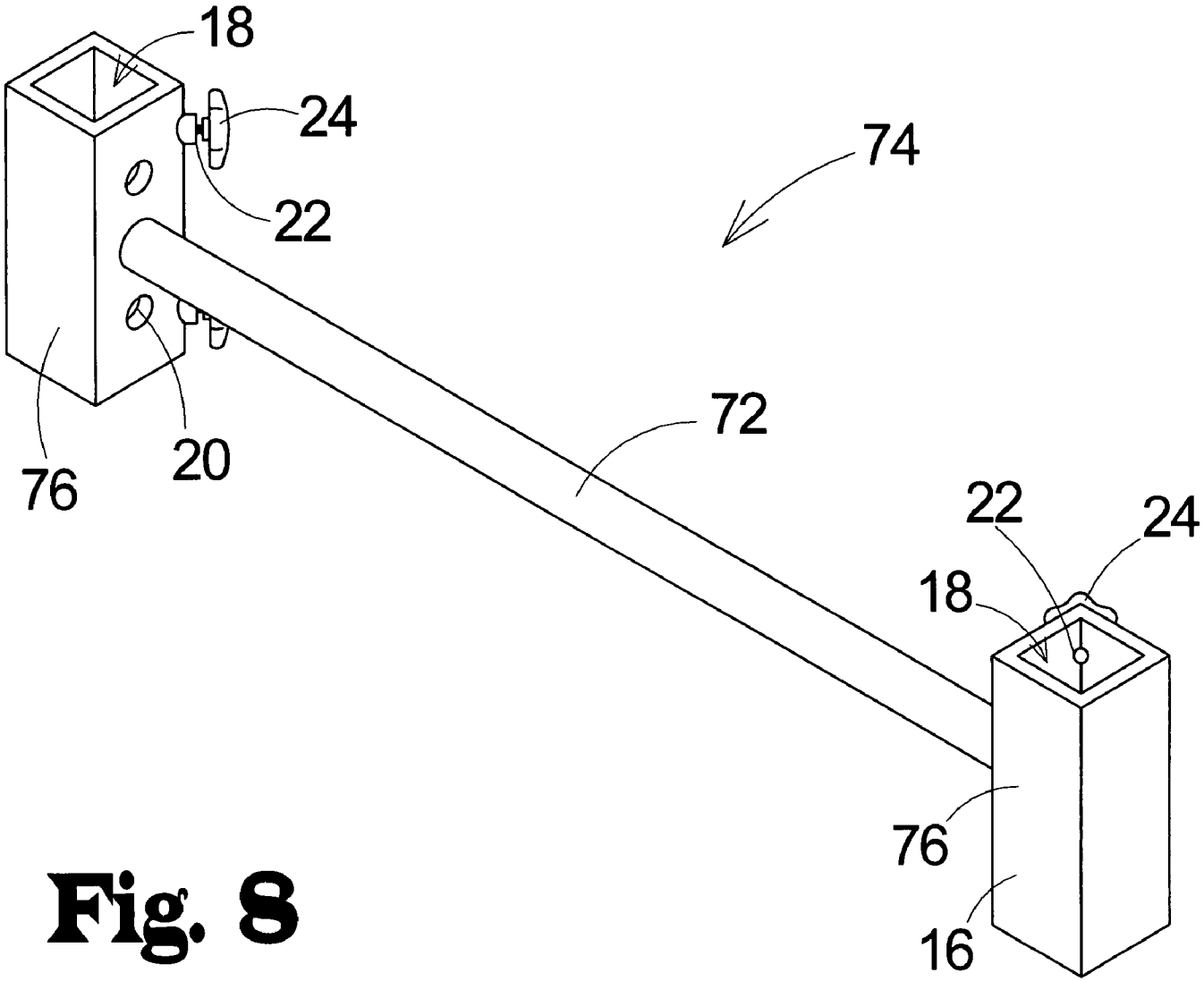
FIG. 8 is a perspective view of an embodiment of a cross post and its constituent parts.

FIG. 8 shows a cross post (74). At a linear end of the cross post (74) is a cross post leg (76) which is similar in design to the frame leg (14) of the main frame (12). Like the frame leg (14) it may include a post throughput (18), leg perimeter (16), a number of first engaging apertures (20), a number of locking apertures (22), and their related locking devices (24) and or coupling members (32) to aid in arranging the universally adjustable bedstead system (10) into its various configurations. Two or more cross post legs (76) may be connected by a cross member (72) much in the same manner as the end assembly (68). The cross post (74) may be connected to posts (48) or end assemblies (68) to couple them together end to end or side to side. By placing the cross post (74) on posts (48) or the tops of end assemblies (68) the cross post may for a functional head or foot board. A cross post (74) of sufficient length may be able to span the distance between posts (48) inserted through the post throughputs (18) of a main frame (12) at opposite ends of a side member (26).

Figure 9:
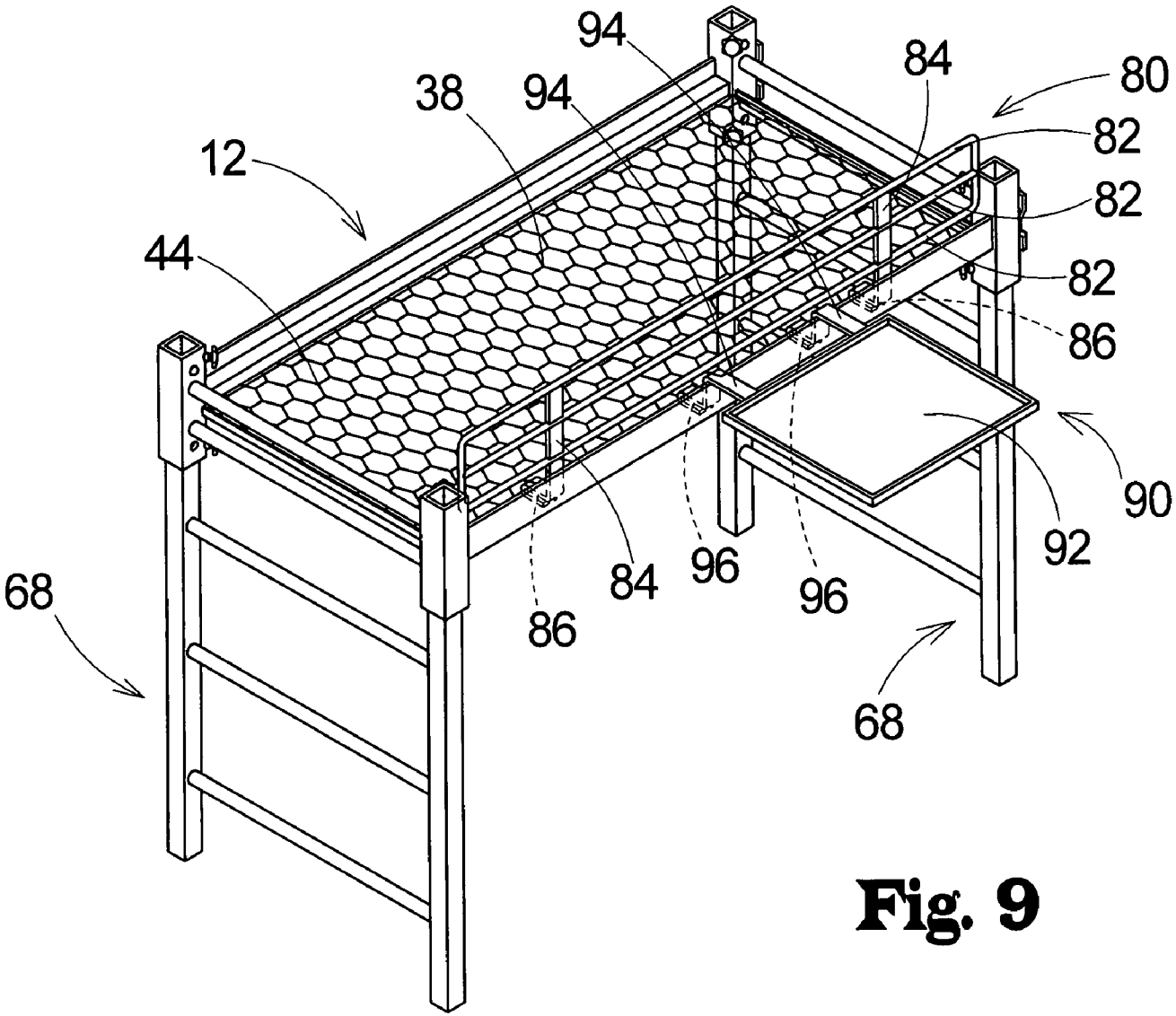
FIG. 9 is a perspective view of an embodiment of the present invention employing a safety rail and shelf.
Figure 10:
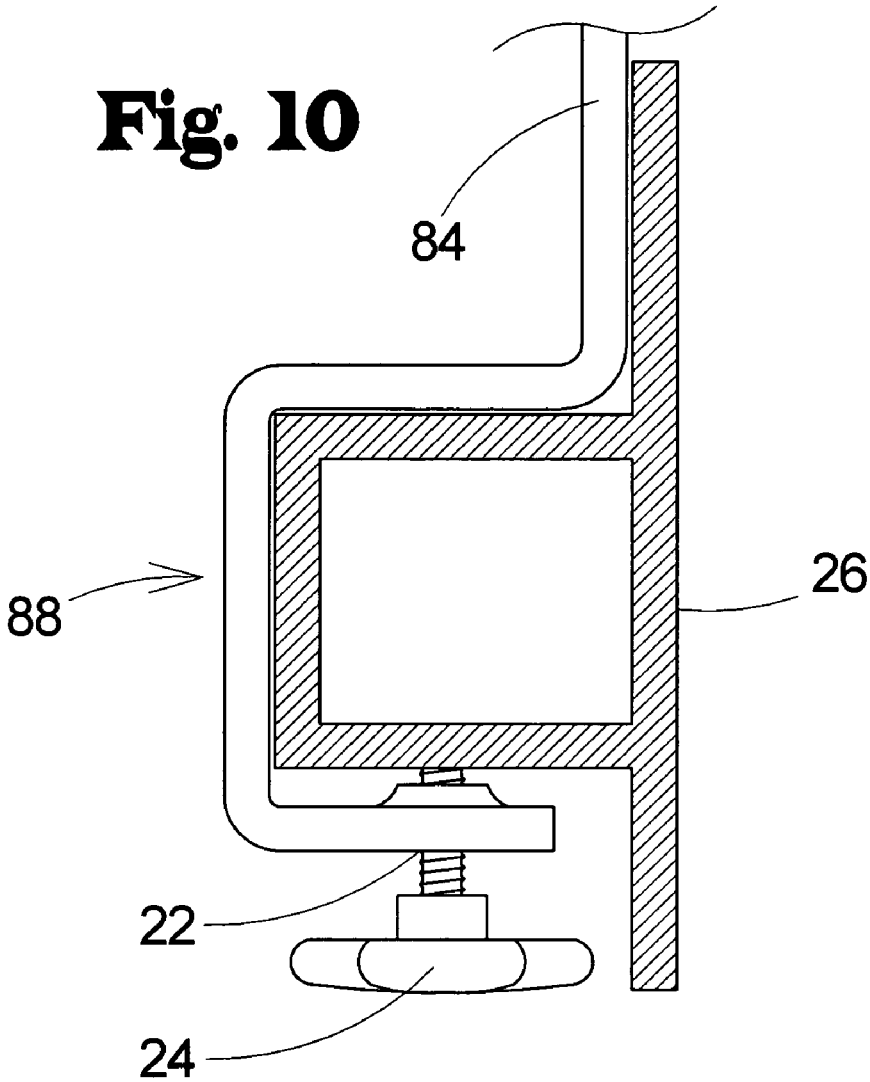
FIG. 10 is a cross-sectional view of two different embodiments of a rail mounting means engaged to a side member of a main frame.
Figure 10:
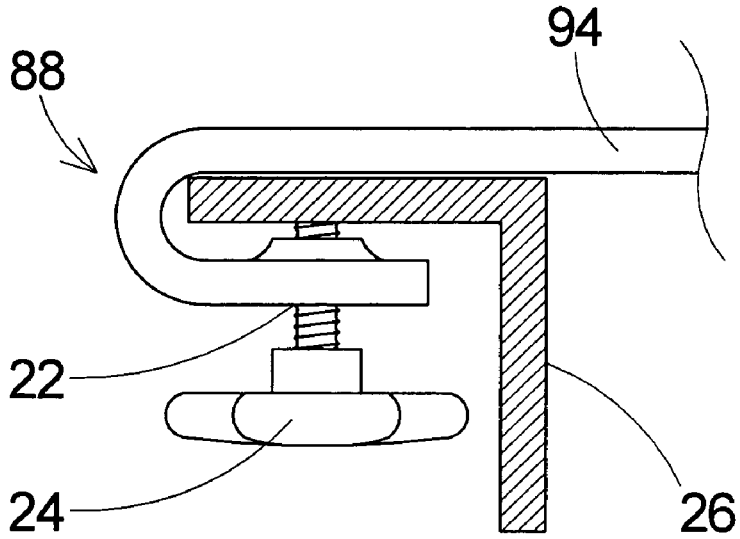

FIG. 9 illustrates a bedstead with accessory assemblies attached. The safety rail (80) accessory is used to prevent the inadvertent discharge of a user from the bedstead while rolling or turning while asleep. In addition the safety rail (80) would also prevent the mattress (2) from moving from its intended position on the main frame (12). The safety rail (80) may consist of a fence (82) which would span a length of space along the side member/s (26) and or the end member/s (28). The fence (82) may be constructed from a series of linear bars as illustrated in FIGS. 1 and 9 but could alternatively be constructed of a series of vertical or diagonal pieces or a frame encompassing a mesh of solid material, line or a solid plate of metal, plastic, wood, fabric or cushion material. The fence (82) may be supported on one or more vertical members (84). A vertical member (84) may be used to connect pieces of the fence (82) together. The vertical members (84) connect the fence (82) to the rail mount (86) and may support the fence (82) at an appropriate height to perform its function of retaining the user. The rail mount (86) may be used to attach the safety rail (80) to the main frame (12) and may use a variety of methods for fastening including, but not limited to; gravity, clamps, friction, apertures with bolts, screws, pins, detents, locking devices (24). The embodiment depicted in FIG. 10 includes a frame catch (88) which is secured with a locking device (24). The frame catch (88) illustrated in FIG. 10 is a continuation of the vertical member (84) which has been formed into a shape that encompasses a portion of the side member (26) on two opposing sides. A locking aperture has been put through the frame catch (88) near the terminal end so that a locking device (24) can be mounted therein. The configuration of the frame catch (88) and the locking device (24) is similar to a C-clamp or tension vice. In FIG. 10 the bottom depiction of an embodiment of a frame catch (88) is designed to encompass one plain of an angle iron which, in this embodiment, constitutes the side member (26). In the top embodiment the side member (26) is comprised of square tubular conduit with a pair of outer lips as depicted in FIG. 4 wherein the frame catch (88) would conform to the depth of the square shape of the side member (26). When the locking device (24) is tightened it provides tension to secure the accessory to the main frame (12). The weight of the mattress (2) and possibly the user may also provide additional bias to hold the rail mount (86) and thus the accessory in place.

Also illustrated in FIG. 9 is a shelf (90) accessory. The shelf (90) may be used to support any number of items the user may access while in bed. Examples may include an alarm clock, food, drink, lights, sleeping aids, telephone, books, and etcetera. The shelf (90) may comprise a platform (92) which may be formed from a solid plate or mesh of sufficiently rigid material. The platform (92) may include a lip or rim along the perimeter or raised dividers throughout its surface separating the platform into a number of depressed surfaces similar to a meal tray. The platform may be supported by one or more support arms (94). The support arm (94) may connect the platform (92) to the shelf mount (96). The shelf mount (96) may be similar in design with the rail mount (86) and use one or more of the various methods to connect the shelf (90) to the side member (26) and or end member (28).

Figure 11:
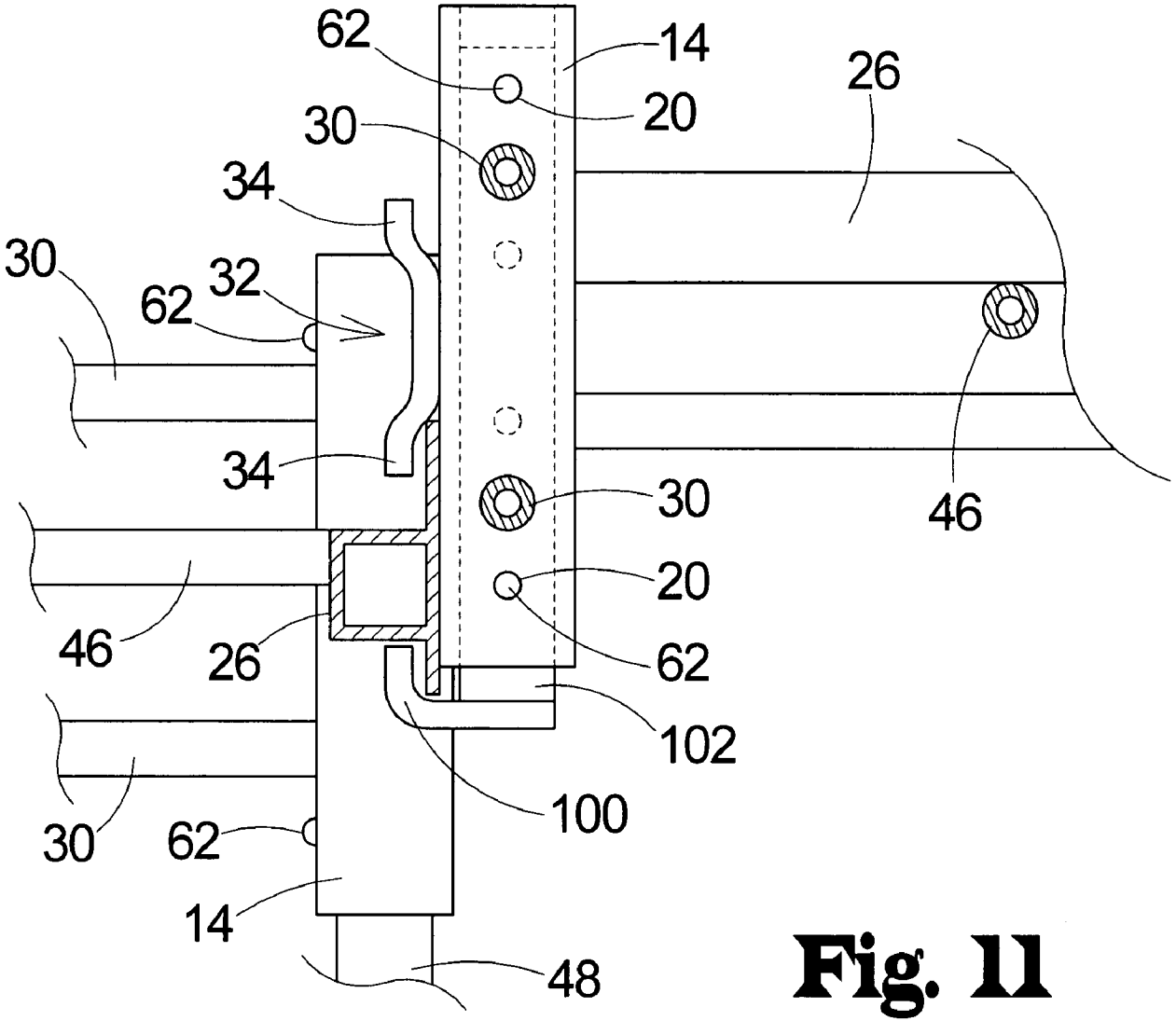
FIG. 11 is a cross-sectional view of two mainframes coupled together using a hook coupling member and mandible.

FIG. 11 is a cross section viewing a method of coupling two main frames (12) through use of a hook (34) coupling member (32) and a mandible (98). In this embodiment the coupling member (32) has been mounted on the end member (28) side of the leg perimeter (16) of the frame leg (14) of the main frame (12). The lower hook (34) is engaged with the upper lip of the side member (26) through the agency of gravity. The gravity biased hook (34) coupling member (32) engaged with the side member (26) has sufficient integrity to support the two main frames (12) to accommodate their respective users but for added protection a mandible (98) has also been employed to lock the two main frames (12) together. The mandible (98) may comprise a clasp (100) designed to engage a side member (26) or end member (28) of a main frame (12) and a throat (102) designed to engage a frame leg (14) through the post throughput (18) using similar methods as a post (48) or end assembly (68).

Figure 12:
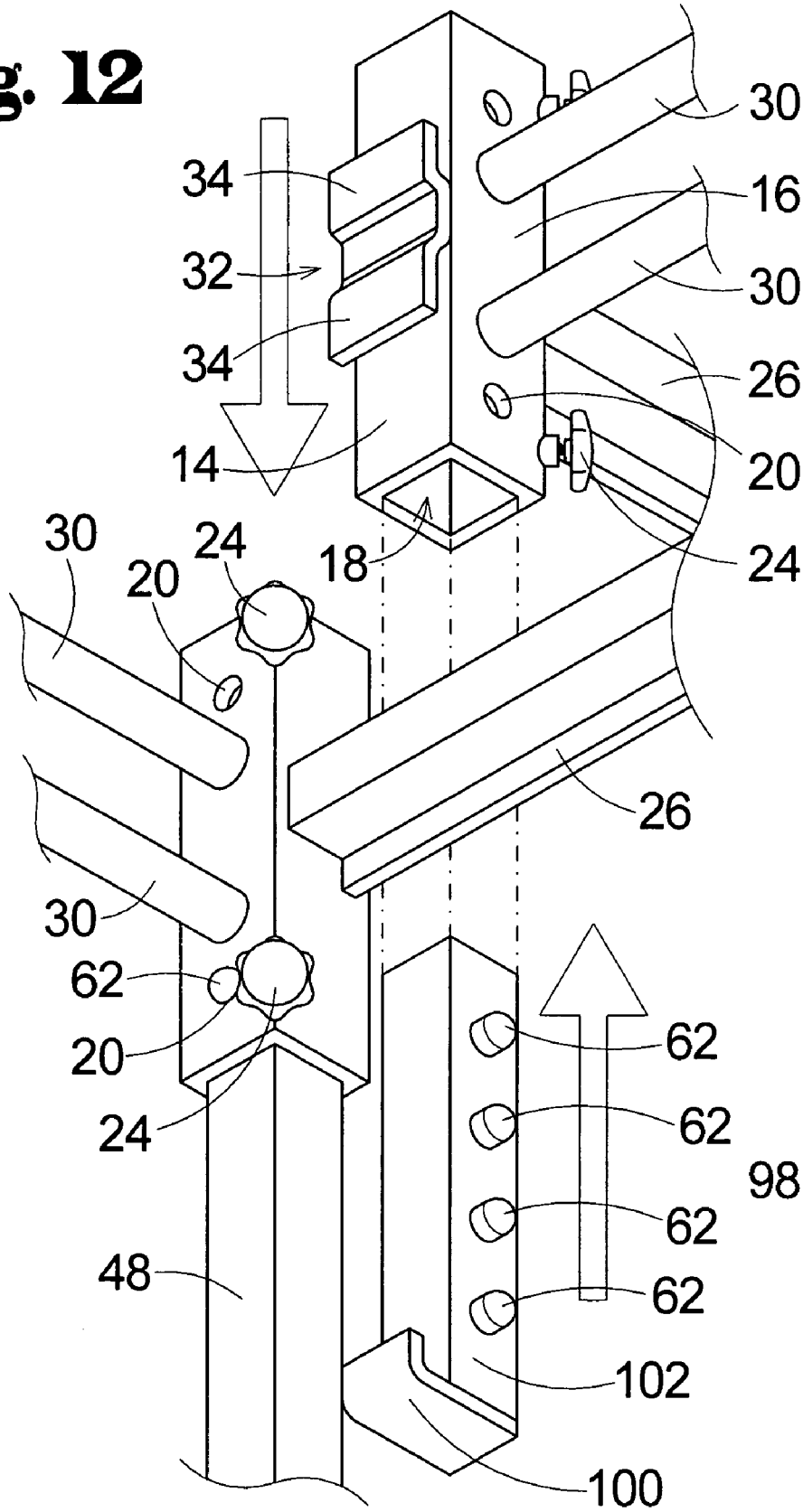
FIG. 12 is a perspective, exploded view of the coupling method of FIG. 11.

FIG. 12 demonstrates the connection method for coupling the two main frames (12) using both the hook (34) coupling member (32) and the mandible (98). In FIG. 11 the bottom hook (34) coupling member (32) is resting on the top edge of the side member (26) and the clasp (100) of the mandible (98) is engaged with the bottom edge of the side member (26) An alternate coupling configuration with this particular embodiment could have the top hook (34) coupling member (32) engaging the bottom edge of the side member (26) and the clasp (100) of the mandible (98) engaging the top edge of the side member (26). Using alternating coupling methods (one with mandible (98) on top and one with mandible (98) on the bottom) it may be possible to couple two main frames (12) directly to each other in a parallel arrangement. All of these configurations of the coupling method can be achieved by determining the engaging points of the coupling member (32) and the side member (26) and determining the entry point of the throat (102) into the post throughput (18).

Through the use of posts (48) and or pillars (70) of an end assembly (68) that may engage a main frame (12) at various levels it may be possible to position one or more mattresses (2) at any level the user may desire. Through the use of various sized posts (48) and or end assemblies (68) possibly joined by main frames (12) and or cross posts (74) it may be possible to regulate the height of a bedstead to various heights. Through the use of coupling members (32) and or mandibles (98) it may be possible to connect two main frames (12) in either a parallel or perpendicular arrangement. In a perpendicular arrangement the end member (28) side of the main frame (12) would be coupled to the side member (26) side of the main frame (12) and in the parallel arrangement like sides (side member (26) side to side member (26) side or end member (28) side to end member (28) side) would be coupled. This functionality of design gives the universally adjustable bedstead system (10) the ability to be configured in an enormous number of configurations to meet requirements of spatial delineations, functional necessities, mattress specifications and individual design preference.

Figure 13:
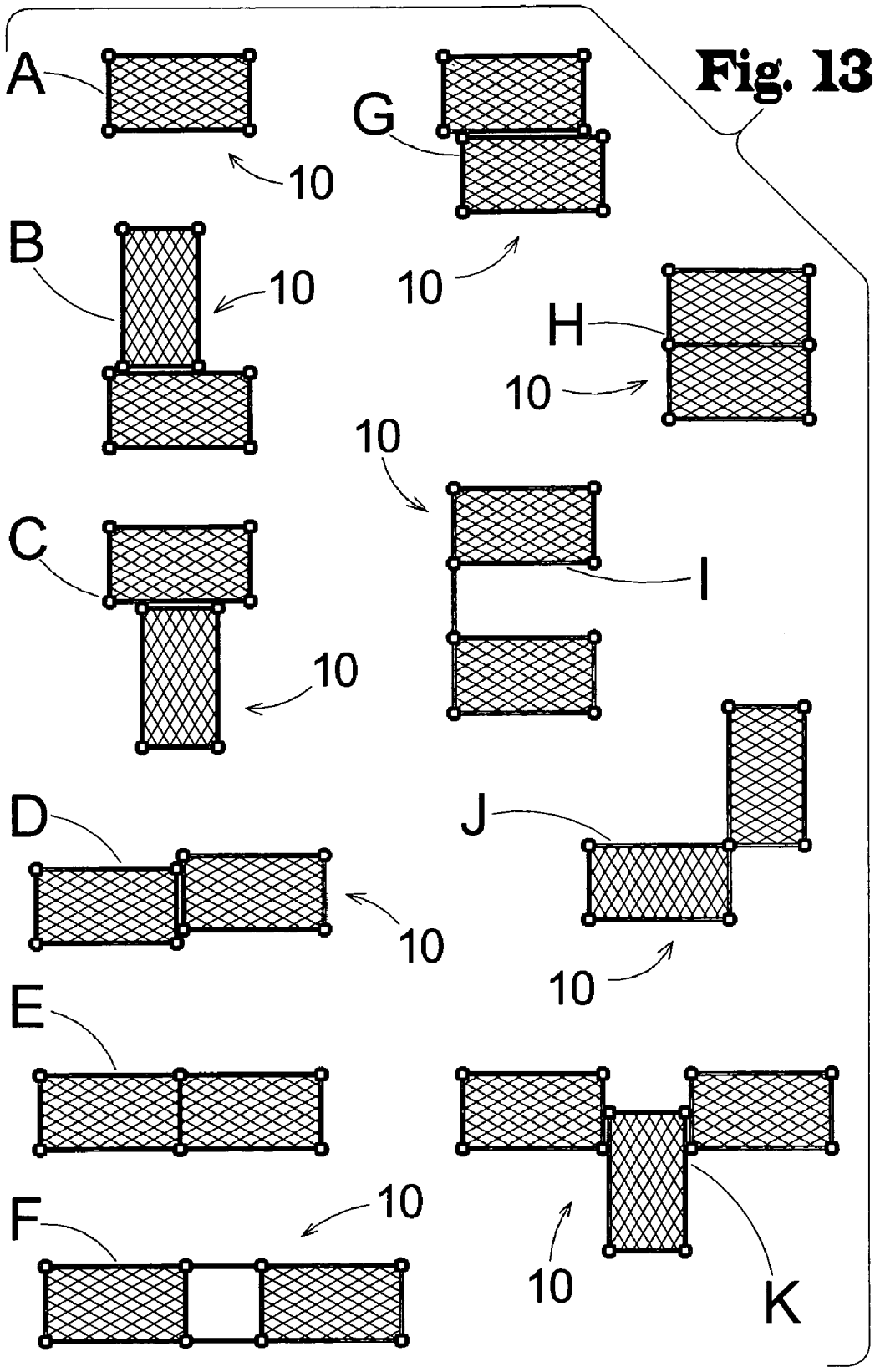
FIG. 13 is a plan view of multiple configurations of the universally adjustable bedstead system.

FIG. 13 shows a variety of plans possible with the universally adjustable bedstead system (10). Note that in each configuration illustrated may include multiple main frames (12) stacked in the space denoted. Configuration (A) signifies a single; solitary, bunked or lofted bedstead. Configuration (A) like all the configurations many have a plurality of methods of construction depending on the individual elements used. For example, Configuration (A) may use a number of posts (48) and or cross posts (74). It may use a pair end of assemblies (68). Or it may use a combination of posts (48) and end assemblie/s (68) with or without cross posts (74). Configuration (B) is an "L" arrangement using coupling members (32) engaged with side members (26). Configuration (C) is a "T" arrangement similar to configuration (B) but with the engagement of the coupling members (32) centered on the side member (26). Configuration (D) is an end to end or tandem arrangement using coupling members (32) engaged with end members (28) which may require alternating use of mandibles (98) as outlined above. Configuration (E) is an end to end or tandem arrangement using shared posts (48) or end assembly (68). Configuration (F) is an end to end or tandem arrangement wherein multiple main frames (12) are joined by a number of cross posts (74) and/or end assemblies (68). Configuration (G) is a side to side or parallel arrangement using coupling members (32) engaged with side members (26) which may require alternating use of mandibles (98). Configuration (H) is a side to side or parallel arrangement using shared posts (48). Configuration (I) is a side to side or parallel arrangement wherein multiple main frames (12) are joined by a number of cross posts (74). In the illustration only one pair of the corners are connected but it is anticipated that both pairs of corners or alternating corners could be joined. Configuration (J) is a perpendicular arrangement wherein the two main frames (12) are joined by a common post (48), number of posts (48) or end assembly (68). Configuration (K) is a multiple perpendicular arrangement using coupling members (32) engaged with side members (26) which may require alternating use of mandibles (98). Configuration (K) demonstrates how multiple configurations can be combined to form more complex bedsteads. Any of these individual arrangements shown can be combined to form barracks or ward designs for large numbers of users. Accessories may be added to any of the pieces to enhance the design as well.

The essence of the universally adjustable bedstead system (10) is that from a collection of adjustable, inter-functional and compatibly designed, interchangeable bedstead elements a bedstead arrangement can be designed, and constructed to meet any specifications of spatial delineations, functional necessities, mattress (2) specifications and individual design preferences.

It is to be understood that the above description is intended to be illustrative, and not restrictive. Many other embodiments will be apparent to those skilled in the art upon reviewing the above description. The scope of the invention should, therefore, be determined with reference to the appended claims, along with the full scope of equivalents to which such claims are entitled.

TABLE OF ELEMENTS

2 Mattress
4 Bed frame
6 Wall
10 Univ. Adj. Bedstead Sys.
12 Main frame
14 Frame leg
16 Leg perimeter
18 Post throughput
20 First engaging aperture
22 Lock aperture
24 Locking device
26 Side member
28 End member
30 Cross piece
32 Coupling member
34 Hook
36 Interior barrier
38 Grid
40 Grid first side
42 Grid second side
44 Mesh panel
46 Strut
48 Post
50 Post end
52 Short post
54 Intermediate post
56 Long post
58 Collar
60 Second engaging aperture
62 Spring biased detent
64 Cap
66 Foot
68 End assembly
70 Pillar
72 Cross member
74 Cross post
76 Cross post leg
80 Safety rail
82 Fence
84 Vertical member
86 Rail mount
88 Frame catch
90 Shelf
92 Platform
94 Support arm
96 Shelf mount
98 Mandible
100 Clasp
102 Throat

What is claimed is:

1. A universally adjustable bedstead system, comprising:
a main frame comprising;
four frame legs located at the corners of said main frame comprising;
a leg perimeter,
a post throughput enclosed by said leg perimeter,
a first engaging member located on the leg perimeter,
a coupling member,
a hook for coupling to a second main frame,
a locking aperture located on the leg perimeter,
a locking device located on the leg perimeter,
a side member,
an end member,
a grid.
at least one complimentarily designed bedstead element selected from the group consisting of;
a post,
an end assembly,
a cross post,
a mandible,
a safety rail,
a shelf.

2. The main frame of claim 1, wherein said end member comprises said cross post.

3. The main frame of claim 1, wherein said main frame is reversible, making available a first grid side and a second grid side which include distinctly different characteristics for receiving a mattress.

4. The universally adjustable bedstead system of claim 1 comprising:
said post comprising:
a cross-sectional shape conformable to the post throughput of a frame leg of a main frame,
a support method for supporting an element selected from the group consisting of;
said main frame,
said cross post.

5. The post of claim 4, wherein said support method comprises:
a second engaging aperture able to correspond with a first engaging aperture of said frame leg of said main frame.

6. The post of claim 5, wherein said second engaging aperture includes a spring biased detent capable of engaging said first engaging aperture of said frame leg of said main frame.

7. The post of claim 4, wherein said support method comprises:
a block comprising:
an obstructive mass attached to said post that inhibits the passage of said post through said post throughput beyond the point of the mass.

8. The post of claim 7, wherein said block comprises a collar which encircles the perimeter of the post.

9. The universally adjustable bedstead system of claim 1 comprising:
said end assembly comprising:
a support method for supporting an element selected from the group consisting of;
a main frame,
a cross post,
a pillar,
a cross member.

10. The end assembly of claim 9 wherein said support method comprises:
a second engaging aperture able to correspond with said first engaging aperture of said frame leg of said main frame.

11. The end assembly of claim 10, wherein said second engaging aperture includes;
a spring biased detent capable of engaging said first engaging aperture of said frame leg of said main frame.

12. The end assembly of claim 9, wherein said support method comprises:
a block comprising:
an obstructive mass attached to the pillar that inhibits the passage of said post through said post throughput beyond the point of the mass.

13. The end assembly of claim 12, wherein said block comprises a collar which encircles the perimeter of said pillar.

14. The universally adjustable bedstead system of claim 1 comprising:

a cross post, comprising;

a cross post leg comprising;

a leg perimeter, a post throughput enclosed by said leg perimeter, a cross member.

15. The cross post of claim 14, wherein said cross post leg includes said first engaging member located on said leg perimeter.

16. The cross post of claim 14, wherein said cross post leg includes a locking aperture and a locking device located on said leg perimeter.

17. The universally adjustable bedstead system of claim 1 comprising:

a safety rail comprising:

a fence, a vertical member, a rail mount.

18. The safety rail of claim 17 wherein said rail mount includes a frame catch that encompasses a portion of said side member.

19. The safety rail of claim 17 wherein said frame catch includes a locking aperture and locking device.

20. The universally adjustable bedstead system of claim 1 comprising:

a shelf comprising:

a platform, a support arm, a shelf mount.

21. The shelf of claim 20 wherein the shelf mount includes a frame catch that encompasses a portion of said side member.

22. The shelf of claim 20 wherein said frame catch includes a locking aperture and locking device.

23. The universally adjustable bedstead system of claim 1 comprising:

a mandible that forms a clamp in conjunction with said hook comprising:

a clasp, a throat, a second engaging aperture mounted on said throat.

24. The mandible of claim 23 wherein said second engaging aperture on said throat includes a spring biased detent capable of engaging said first engaging aperture of said frame leg of said main frame.

* * * * *